US008407962B2

(12) United States Patent
Cahill et al.

(10) Patent No.: US 8,407,962 B2
(45) Date of Patent: Apr. 2, 2013

(54) PLASTIC SIDING PANEL

(75) Inventors: John Cahill, Hudson, OH (US); Craig Ferriot, Hudson, OH (US); Roger Peck, Wadsworth, OH (US); Chris Shepherd, Isaaqhah, WA (US)

(73) Assignees: National Shelter Products, Issaquah, WA (US); American Original Building Products, LLC, Akron, OH (US)

( * ) Notice: Subject to any disclaimer, the term of this patent is extended or adjusted under 35 U.S.C. 154(b) by 81 days.

(21) Appl. No.: 11/906,048

(22) Filed: Sep. 28, 2007

(65) Prior Publication Data

US 2009/0084058 A1 Apr. 2, 2009

(51) Int. Cl.
*E04F 13/00* (2006.01)
*E04D 1/00* (2006.01)
*E04D 1/34* (2006.01)

(52) U.S. Cl. ..... 52/542; 52/520; 52/545; 52/546

(58) Field of Classification Search ..... 52/473, 52/542, 518, 519, 546, 36.4, 36.5, 536, 520, 52/521, 539, 543, 545
See application file for complete search history.

(56) References Cited

U.S. PATENT DOCUMENTS 3,127,960 A * 4/1964 Smith et al. ..... 52/222
3,233,382 A * 2/1966 Graveley, Jr. ..... 52/522
3,282,009 A * 11/1966 Chalmers ..... 52/531
3,325,952 A * 6/1967 Trachtenberg ..... 52/276
3,473,274 A * 10/1969 Godes ..... 52/127.5
RE29,462 E * 11/1977 Tchakgarian ..... 40/545
4,327,528 A * 5/1982 Fritz ..... 52/309.1
4,522,002 A * 6/1985 Davis et al. ..... 52/309.1
4,712,351 A * 12/1987 Kasprzak ..... 52/573.1
5,072,562 A 12/1991 Crick et al.
5,076,037 A 12/1991 Crick et al.
5,249,402 A * 10/1993 Crick et al. ..... 52/533
5,277,011 A * 1/1994 Serrano Martin ..... 52/588.1
5,347,784 A 9/1994 Crick et al.
5,455,099 A * 10/1995 Banner ..... 428/122
5,537,791 A * 7/1996 Champagne ..... 52/520
5,537,792 A 7/1996 Moliere
5,564,246 A * 10/1996 Champagne ..... 52/548
5,606,835 A * 3/1997 Champagne ..... 52/545
5,651,227 A * 7/1997 Anderson ..... 52/520
5,979,118 A * 11/1999 Gortsema et al. ..... 52/36.1
6,224,701 B1 * 5/2001 Bryant et al. ..... 156/73.1
6,415,574 B2 * 7/2002 Beck ..... 52/519
6,516,577 B2 * 2/2003 Pelfrey et al. ..... 52/536
6,561,474 B1 * 5/2003 Walter et al. ..... 52/36.4
6,684,587 B2 * 2/2004 Shaw et al. ..... 52/288.1
6,715,250 B2 4/2004 Bryant et al.
(Continued)

*Primary Examiner* — Brian Glessner
*Assistant Examiner* — Joseph J Sadlon
(74) *Attorney, Agent, or Firm* — Hahn, Loeser & Parks, LLP

(57) ABSTRACT

A molded plastic sliding panel used for covering an exterior building wall surface is made up of a body portion, an attachment portion provided above and adjacent to the body portion, a top locking portion extending horizontally across an upper portion of the sliding panel and a bottom locking portion provided at the bottom of the body portion. The top locking portion is adapted to engage with the bottom locking portion on an upper adjacent siding panel. The attachment portion can contain a plurality of apertures provided therein which sequentially become more elongated as they are positioned toward a side edge of the attachment portion in order to deal with thermal expansion and contraction of the panel.

16 Claims, 6 Drawing Sheets

U.S. PATENT DOCUMENTS

| | | | | |
|---|---|---|---|---|
| 6,955,019 | B2 | 10/2005 | Donlin et al. | |
| 7,127,869 | B2 | 10/2006 | Perry | |
| 7,228,665 | B2 | 6/2007 | Perry | |
| D568,496 | S | 5/2008 | Trabue et al. | |
| 7,698,864 | B2 * | 4/2010 | Justice et al. | 52/519 |
| 7,735,286 | B2 * | 6/2010 | Trabue et al. | 52/518 |
| 7,980,037 | B2 * | 7/2011 | Trabue et al. | 52/522 |
| 7,980,038 | B2 * | 7/2011 | O'Neal | 52/551 |
| 2007/0144095 | A1 * | 6/2007 | King | 52/518 |
| 2008/0098683 | A1 * | 5/2008 | Trabue et al. | 52/520 |

* cited by examiner

PLASTIC SIDING PANEL

FIELD OF THE INVENTION

The present invention relates to molded plastic siding panels which are used to cover an exterior building wall surface and, in particular, to a molded plastic siding panel which has improved locking and attachment features.

BACKGROUND OF THE INVENTION

Molded plastic siding panels used on exterior wall surfaces are well known in the prior art. These siding panels are typically made of synthetic thermoplastic polymers and are nailed to a wall support surface in horizontal rows partially overlapping each other for aesthetic purposes. The siding panels are typically installed on a wall surface starting with a bottom course and nailing several adjacent courses. Side marginal edge regions of each panel can mate with adjacent panels utilizing a male-female tongue-in-groove configuration.

Various arrangements have been proposed for interlocking a siding panel with another siding panel provided directly above it. For example, U.S. Pat. No. 6,224,701 to Bryant et al discloses a molded plastic panel for covering an exterior building wall. The panel has a panel body which includes a locking lip for engaging a locking tab on an adjacent panel and a flexible hinge which connects the locking lip to the panel body. The panel also has an attachment hem or nail hem adjacent to a top wall having laterally elongated, laterally spaced nail slots 31 of the same size for locating nails.

U.S. Pat. No. 6,955,019 to Donlin et al shows a wall covering comprising a plurality of plastic panels which are mounted on a support surface with a lower marginal edge region of one panel overlaying an upper marginal edge region of a previously mounted panel in a lower course and with a side marginal edge region of one panel overlying the side marginal edge region of the previously mounted adjacent panel in the same course. The marginal edge regions are provided with interlocks which engage and secure both the overlapping upper and lower marginal edge regions and the overlapping side marginal edge regions. For securing a panel to a support surface, the upper marginal edge region of each panel is formed with a row of elongated laterally spaced nailing apertures of the same size.

In conventional panels which have intermittent locks, the siding installers may occasionally miss a lock and due to the line of sight during the installation, it may not be detected until the installer is finished with the installation and is reviewing the work. The missed lock would then be readily apparent and the correction of this would require the installer to reset the panel.

Although U.S. Pat. No. 6,715,250 discloses a conventional siding panel which utilizes a continuous lock feature in which the panel is injection molded with a living hinge which is folded and welded to the panel to form the top lock, this panel requires additional steps to form the top lock.

Additionally, conventional siding panels are provided with nail slots having a center nail hole that substantially anchors the location of the panel with all of the other nail holes being slots of the same size in which nails are inserted and left slightly raised so they do not anchor the panel to the wall and thereby allow the panel to expand and contract with a change in temperature and still remain flat on the wall. However, these conventional panels have a problem in that the center hole must be aligned with a stud in a non-nail based sheathing installation, i.e., a sheathing not capable of adequately supporting a fastener.

SUMMARY OF THE INVENTION

It is an object of the present invention to provide a molded plastic siding panel having a continuous top interlocking mechanism that will easily allow the alignment of adjacent siding panels during installation.

It is a further object of the present invention to provide a plastic siding panel having an attachment portion with nail slots provided therein which allow any slot provided on the panel to be used for the center location, such that the stud closest to the center of the panel to be the anchoring nail location.

It is still a further object of the present invention to provide a plastic siding panel having an attachment portion with nail slots provided therein which allows any nail slot provided on the panel to be used as the centermost anchoring location regardless of the cut in the panel or location of intermediate framing members.

These and other objects of the present invention are met by providing a monolithic molded plastic siding panel which is made in one molding process and comprises a continuous top interlocking mechanism which facilitates an easier installation by minimizing the chances of a non-continuous top interlocking mechanism not engaging with a bottom interlocking mechanism provided on an adjacent panel.

These and other objects of the present invention are met by providing a plastic siding panel which has a continuous top interlocking mechanism formed by a separate member which engages with the attachment portion in a snap-fit connection.

These and other objects of the present invention are also met by providing a plastic siding panel having an attachment portion containing apertures which gradually become more horizontally elongated as they are positioned away from a center portion of the attachment portion, thereby enabling any of the apertures to serve as a center anchoring position.

DETAILED DESCRIPTION OF THE INVENTION

Figure 1:
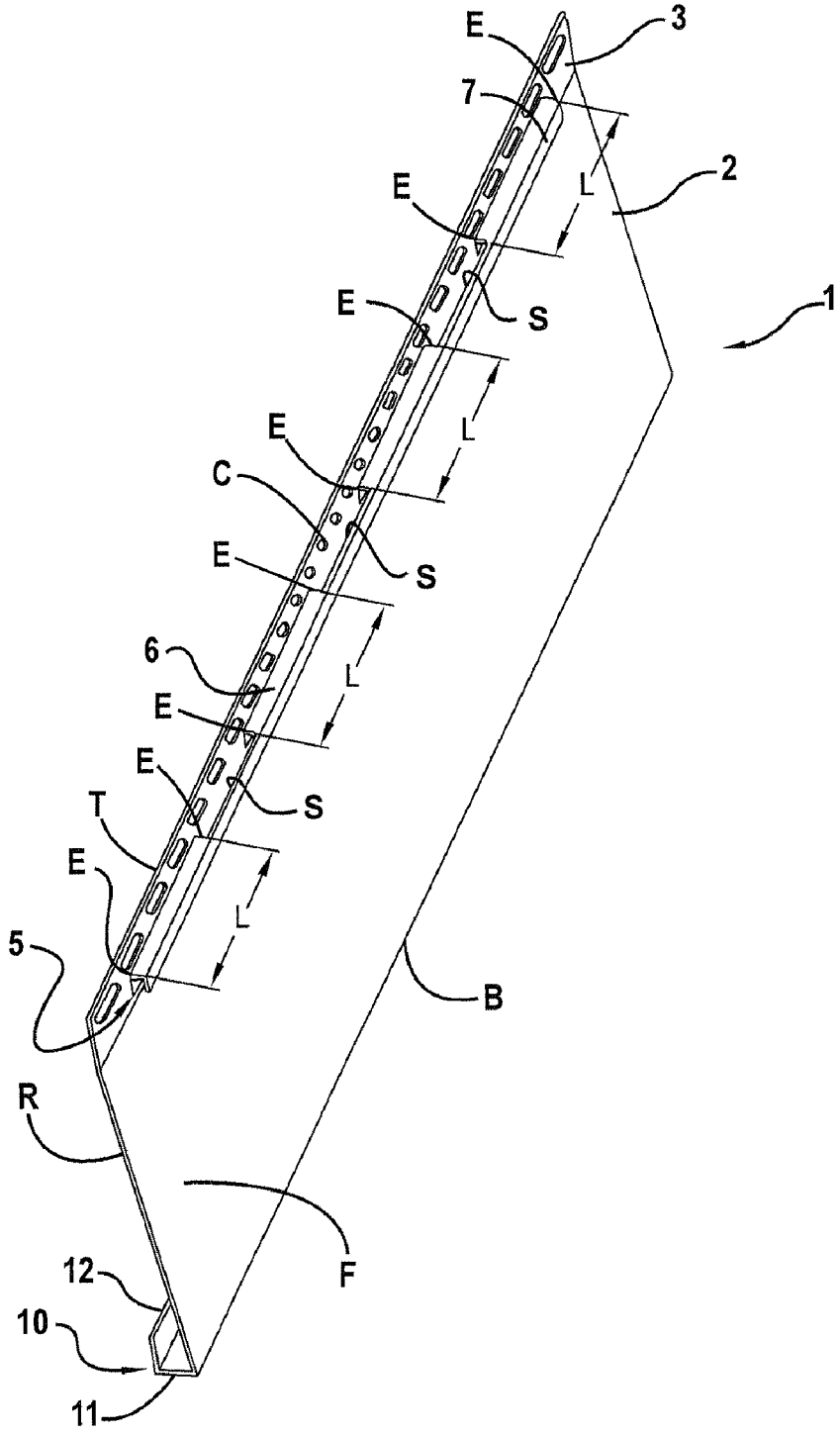
FIG. 1 illustrates the top and bottom locking mechanisms of a plastic siding panel according to an embodiment of the present invention.

FIG. 1 illustrates an embodiment of a plastic siding panel 1 according to the present invention. The plastic siding panel 1 is monolithic and is prepared by molding a thermoplastic resin selected from the group consisting of a polyolefin, a polycarbonate, polyvinyl chloride, and mixtures and copolymers thereof. Preferably, the thermoplastic resin is a polyolefin, with polypropylene being especially preferred. Conventional additives used in siding panels can be present in the siding panel of the present invention and include fillers, pigments, UV inhibitors, anti-oxidants, etc.

The thermoplastic resin can be formed into the monolithic plastic siding panel of the present invention by conventional molding processes such as injection molding, compression molding, transfer molding, extrusion molding, blow molding, etc., with injection molding being preferred. As illustrated in FIG. 1, the monolithic molded plastic siding panel 1 of the present invention comprises a rectangular shaped body portion 2 and a strip-shaped attachment portion 3 provided immediately above and adjacent to the body portion 2. Panel 1 has a top edge T, a bottom edge B, and front and rear surfaces F, R.

Figure 3:
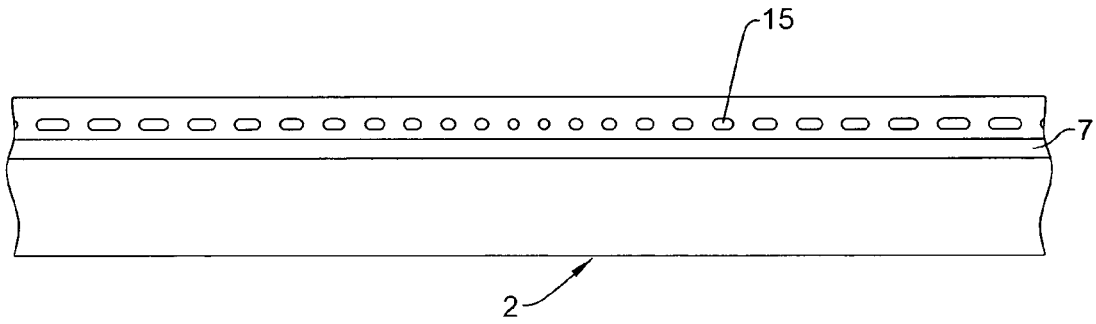
FIG. 3 illustrates the apertures contained in an attachment portion of a plastic siding panel according to an embodiment of the present invention.

As illustrated in FIGS. 1 and 3, an embodiment of an attachment portion 3 of the present invention is provided with a plurality of apertures 15 which sequentially become more horizontally elongated as they are positioned away from a center position C on the attachment portion 3. The apertures 15 serve as nail slots for fastening the plastic siding panel 1 to a wall structure. The varying widths of the apertures 15 eliminate the need to initially fasten the panel through a center nail slot and will prevent the siding panel 1 from distorting in dramatic temperatures regardless of the width of the panel. It is only necessary that the fastener be placed at the center of the aperture or nail slot 15. Markings can be provided on the attachment portion 3 to indicate the center of the nail slots 15 and/or the nail slots may be formed to guide the fasteners into the proper position.

Figure 10:
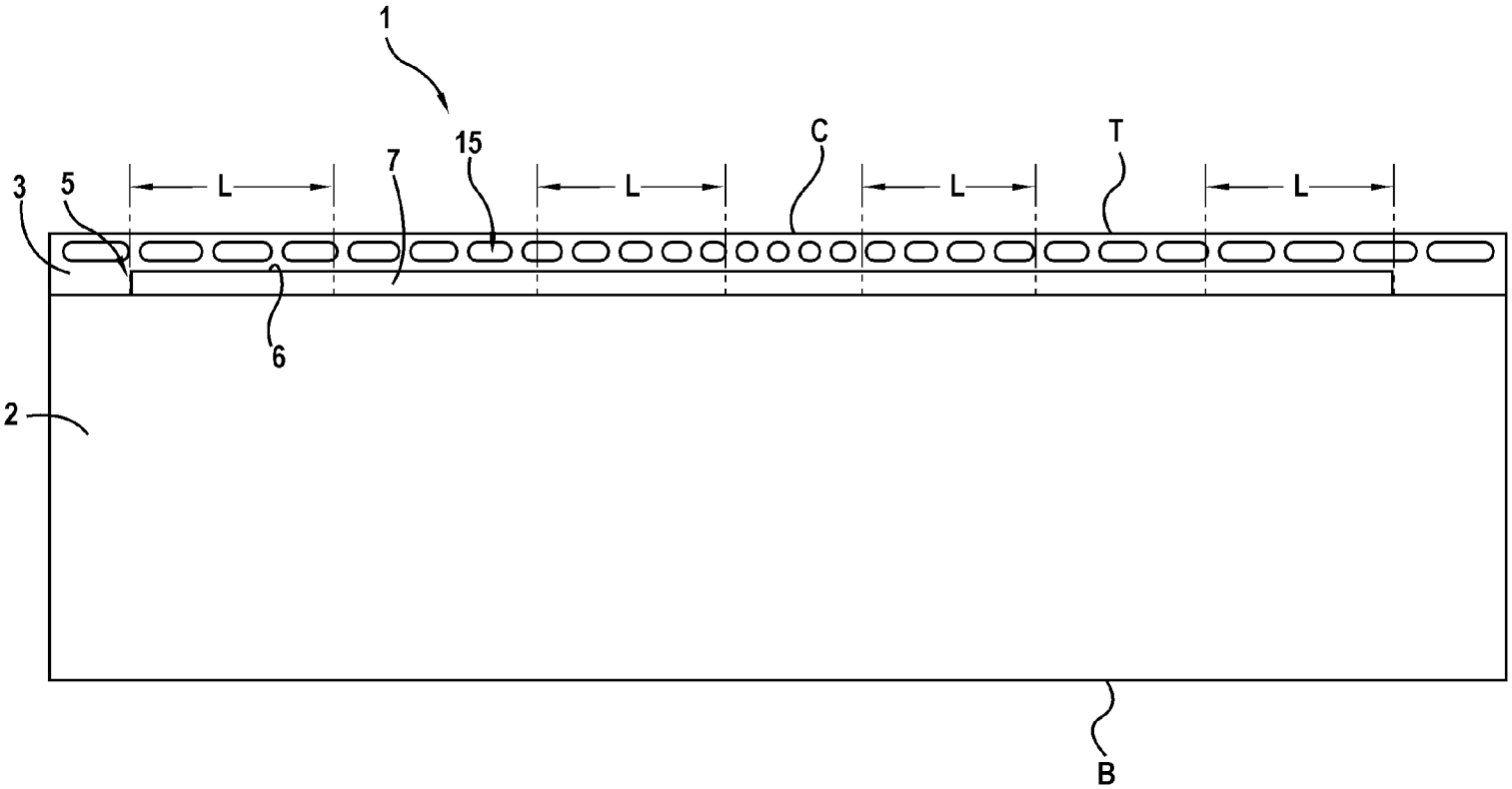
FIG. 10 is a front elevational view.

A continuous top interlocking mechanism 5 is provided on an upper portion of the siding panel 1, preferably on the attachment portion 3 immediately below the apertures 15. The top interlocking mechanism 5 is adapted to engage with a bottom interlocking mechanism 10 provided on an adjacent panel to align the panels on the wall structure during installation. As illustrated in FIG. 1, the top interlocking mechanism 5 comprises a plurality of spaced-apart ledge portions 6 which extend laterally from the attachment portion 3. Each ledge portion 6 has a length L. As seen in FIGS. 1 and 10, the length L is defined by the distance between the edges E of each ledge portion 6. At least two whole apertures 15 are located within length L of each ledge portion 6. The spaced-apart ledge portions 6 are separated by ledge slots S and joined by a continuous side wall portion 7 which is joined to and extends downwardly from the ledge portions 6. Alternatively, the continuous top interlocking mechanism 5 can be provided on the attachment portion 3 above the apertures 15 without departing from the scope of the present invention.

At a lower portion of the body portion 2, a bottom interlocking mechanism 11 is provided. The bottom interlocking mechanism 10 comprises a continuous ledge portion 11 which extends laterally along the length of the body portion 2 in a direction opposite to the ledge portions 6 and a continuous lip portion 12 which extends upwardly from the continuous ledge portion 11. The bottom interlocking mechanism 10 is adapted to resiliently engage with the top interlocking mechanism 5 through the resilient engagement between the continuous side wall 7 and the continuous lip portion 12. As with conventional siding panels, a longitudinally extending groove can be provided in one of the side surfaces of the body portion 2 and a longitudinally extending ridge can be provided in the opposite side surface which is adapted to engage with a longitudinally extending groove provided in an adjacent siding panel.

Figure 2:
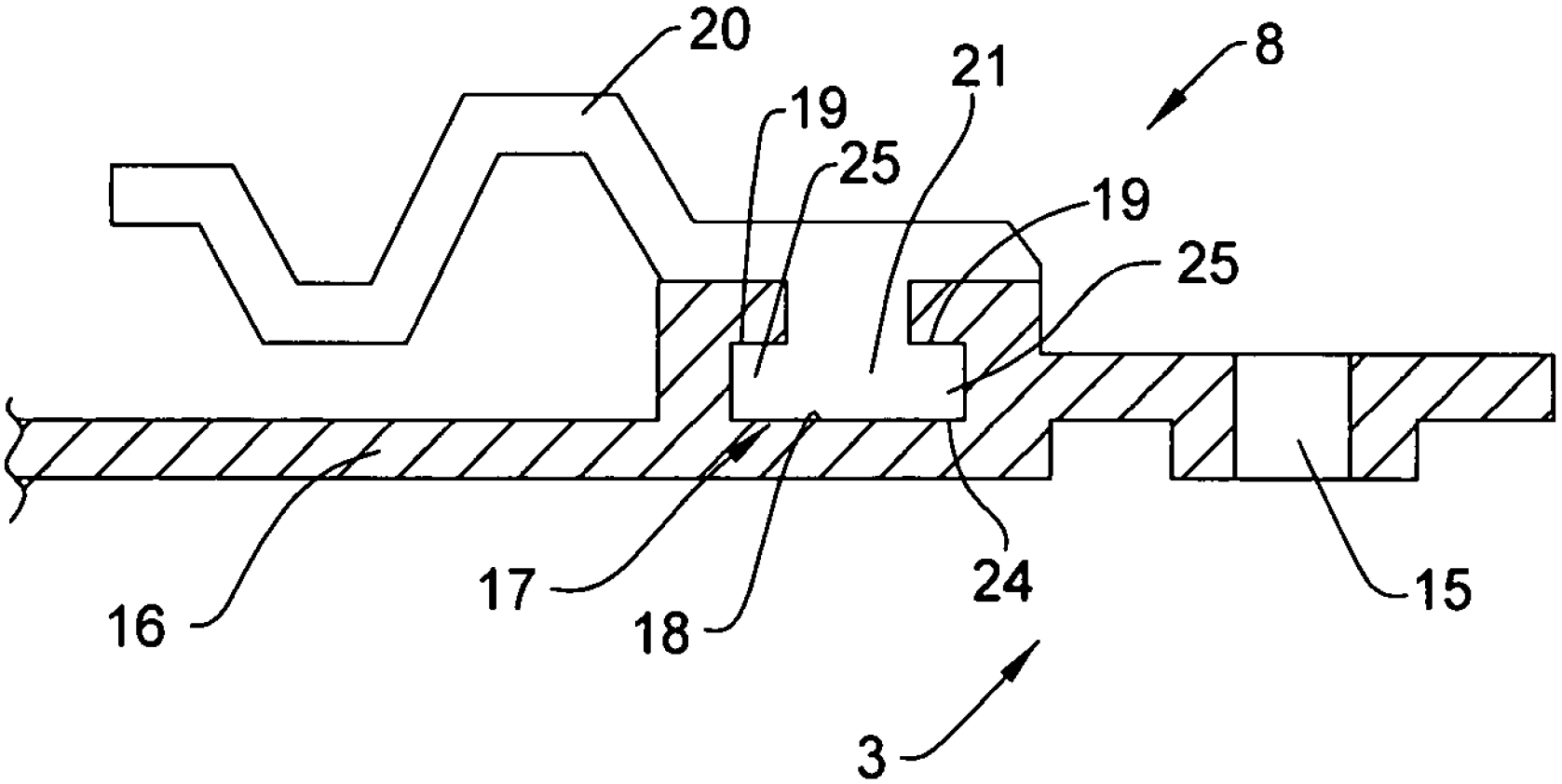
FIG. 2 illustrates a top interlocking mechanism of a plastic siding panel according to another embodiment of the present invention.

Another embodiment of the top interlocking mechanism 8 of the present invention is illustrated in FIG. 2. In this embodiment, the attachment portion 3 is molded to form a first connection member 16 containing a space 17 defined by a bottom wall 18 and inwardly extending lips 19 which is adapted to receive a plug portion 21 of a second connection member 20. The second connection member 20 is an extruded part which extends laterally continuously along the width of the attachment portion 3 and together forms the top interlocking mechanism 5 with the first connection member 16 when the plug portion 21 is engaged in the space 17. The plug portion 21 has a bottom wall 24 which flush engages with the bottom wall 18 of the space 17 and outwardly extending lips 25 having a top surface which sealingly engages with the bottom surface of lips 19 to firmly attach the second connection member 20 to the first connection member 16 and form another embodiment of the continuous top interlocking mechanism 5 of the present invention.

Figure 9:
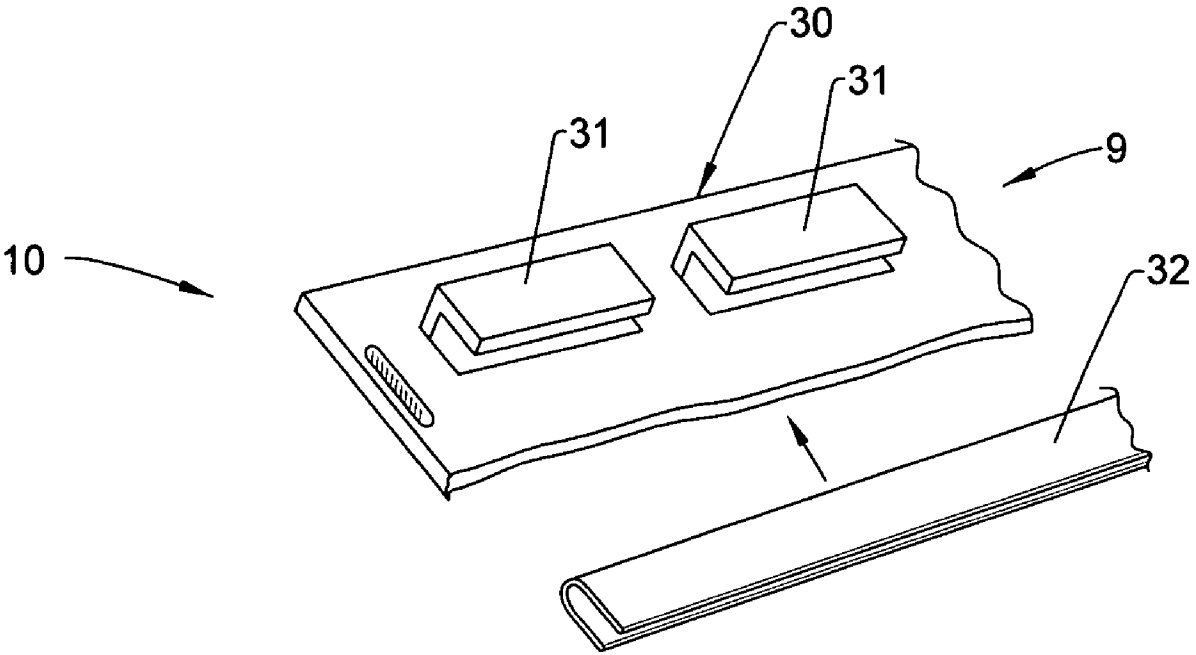
FIG. 9 illustrates an embodiment of an attachment portion of a siding panel of the present invention where a conventional siding top interlocking mechanism is converted into a continuous top interlocking mechanism of the present invention.

FIG. 9 illustrates another embodiment of the top interlocking mechanism 9 of the present invention wherein a conventional top interlocking mechanism 30 made up of a plurality of "L-shaped" spaced-apart locking members 31 is converted to a continuous top interlocking mechanism of the present invention by inserting a continuous "U-shaped" member 32 by inserting U-shaped member 32 under the L-shaped member 31 along the entire width of the attachment portion 10.

Figure 4:
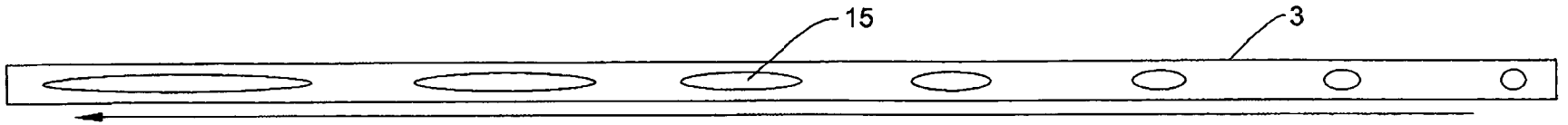
FIG. 4 illustrates an embodiment of an attachment portion of a siding panel of the present invention where the nail slots progressively become wider as they extend from right to left.
Figure 6:
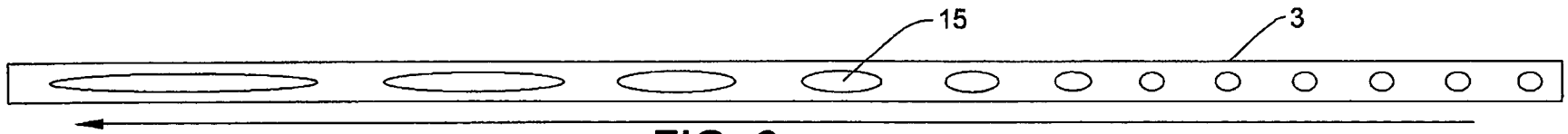
FIG. 6 illustrates an embodiment of an attachment portion of a siding panel of the present invention where the nail slots have the same width for a portion of the right side of the siding attachment portion and then progressively become wider as they extend from right to left.
Figure 5:
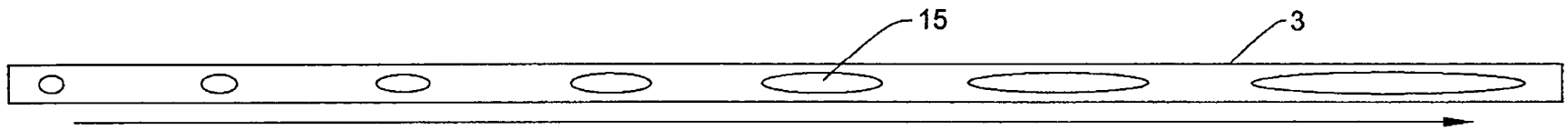
FIG. 5 illustrates an embodiment of an attachment portion of a siding panel of the present invention where the nail slots progressively become wider as they extend from left to right.
Figure 7:
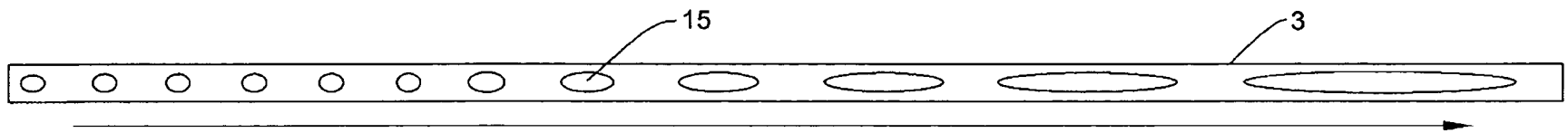
FIG. 7 illustrates an embodiment of an attachment portion of a siding panel of the present invention where the nail slots have the same width for a portion of the left side of the siding attachment portion and then progressively become wider as they extend from left to right.
Figure 8:
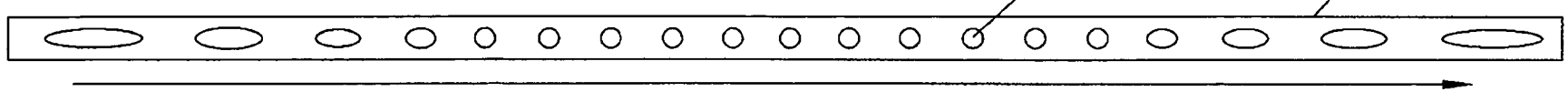
FIG. 8 illustrates an embodiment of an attachment portion of a siding panel of the present invention where the nail slots have the same width at a center portion of the siding attachment portion and then progressively become wider as they extend outwardly from the siding center portion.

FIGS. 4-8 all illustrated different embodiments of the nail slots 15 provided on an attachment portion 3 of the present invention. In FIG. 4, the nail slots 15 progressively become wider as they are provided in the leftward direction on the attachment portion 3. FIG. 5 illustrates an embodiment of an attachment portion 3 of the present invention in which the nail slots 15 progressively become wider as they are provided in the rightward direction along the attachment portion 3. FIG. 6 illustrates an attachment portion 3 according to an embodiment of the present invention where the nail slots 15 have a constant size at the right side of the attachment portion 3 and then become progressively wider as they are provided in the leftward direction along the attachment portion 3. FIG. 7 illustrates another embodiment of an attachment portion 3 of the present invention where the nail slots 15 have a constant size at the left side of the attachment portion 3 and then become progressively wider as they are provided in the rightward direction along the attachment portion 3. FIG. 8 illustrates an attachment portion 3 according to another embodiment of the present invention wherein the nail slots 15 have a constant size at a central portion of the attachment portion 3 and become progressively wider as they are provided outwardly from the central portion of the attachment portion 3.

By providing the attachment portion 3 with nail slots 15 having a different width, it is not necessary for a center nail slot of an attachment portion to be centered on a nail stud during installation of the plastic siding as the varying widths of at least some of the nail slots 15 allow them to be used as the center nail slot and still give the siding panel the ability to compensate for thermal expansion and reduction. Additionally, the attachment portion of the present invention having nail slots of varying widths are especially suitable for use in non-nail based sheathing applications using rigid foam, gypsum, etc. where the varying widths of the nail slots allow the nails slots to be easily located over a framing member without the need for a center nail hole to be provided over a framing member, or in installations where a sheathing member is not used.

The body 2 of the siding panels of the present invention can be provided with a decorative pattern characteristic of conventional roofing and siding materials such as shake shingles, tile, brick or the like and the color of the siding panel can be evenly distributed throughout the resin, painted on the siding panel or achieved by a combination thereof. Moreover, since the monolithic plastic siding panels of the present invention are molded in one molding process step, there is no need for hinges or other attached components as is typically required with the prior art plastic siding panels.

Although the present invention has been described in connection with specific embodiments, it is not limited to the particular constructions herein disclosed and shown in the drawings and also comprises any modifications or equivalents within the scope of the appended claims.

What is claimed is:

1. A monolithic molded plastic siding panel comprising:

an elongated panel body having a top edge and a bottom edge, the panel body further having front and rear surfaces;

an attachment portion extending for a substantial length along the top edge of the panel body and defining a plurality of apertures therein;

a top interlocking mechanism located on said panel body front surface and in proximity to said panel body top edge and extending substantially across the length of said body, said top interlocking mechanism comprising a plurality of spaced apart ledges extending outward from the body and defining a plurality of ledge slots therebetween, each of the ledges having a downwardly-extending sidewall, wherein each sidewall is spaced outward from the front surface of said panel body to define a recess between the front surface of the panel body and the sidewall;

a u-shaped member receivable between the downwardly-extending sidewalls of the plurality of spaced apart ledge portions and the panel body, wherein the u-shaped member extends substantially along of the length of the panel body and opens downwardly; and a bottom interlocking mechanism located on said panel body rear surface and in proximity to said panel body bottom edge and extending substantially across the length of said body, said bottom interlocking mechanism comprising a ledge extending outward from the body and a continuous sidewall extending upward from said ledge, wherein at least two whole apertures of said attachment portion are located within a length defined by each spaced apart ledge.

2. The monolithic molded plastic siding panel of claim 1, wherein the ledge of said bottom interlocking mechanism is continuous.

3. The monolithic molded plastic siding panel of claim 1, wherein at least three whole apertures of said attachment portion are located within the length defined by each spaced apart ledge.

4. The monolithic molded plastic siding panel of claim 1, wherein the ledges are provided underneath the apertures.

5. The monolithic molded plastic siding panel of claim 1, wherein said front surface of the body has a shake-shingle pattern molded therein.

6. The monolithic molded plastic siding panel of claim 1, wherein the panel body is made of a thermoplastic resin selected from the group consisting of a polyolefin, a polycarbonate, polyvinyl chloride, and mixtures and copolymers thereof.

7. The monolithic molded plastic siding panel of claim 1, wherein said apertures in said attachment portion sequentially become more elongated as they are positioned outward from a center position in said attachment portion.

8. A molded plastic siding panel comprising:

a panel body having a top edge and a bottom edge, said panel body having a front surface and a rear surface;

an attachment portion extending for a substantial length along the top edge of the panel body and defining a plurality of apertures therein;

a top interlocking mechanism located on said panel body front surface and in proximity to said panel body top edge and extending substantially across the length of said body, said top interlocking mechanism comprising a plurality of spaced apart ledges extending outward from said panel body in proximity to the plurality of apertures and defining a plurality of ledge slots therebetween, each of the ledges having a downwardly-extending sidewall, wherein each sidewall is spaced outward from the front surface of said panel body;

a u-shaped member receivable between the downwardly-extending sidewalls of the plurality of spaced apart ledge portions and the panel body, wherein the u-shaped member extends substantially along of the length of the panel body and opens downwardly; and a bottom interlocking mechanism located on said panel body rear surface and in proximity to said panel body bottom edge and extending substantially across the length of said body, said bottom interlocking mechanism comprising a ledge extending outward from the body and a continuous sidewall extending upward from said ledge.

9. The molded plastic siding panel of claim 8, wherein at least two whole apertures of said attachment portion are located within a length defined by each spaced apart ledge.

10. The molded plastic siding panel of claim 8, wherein said apertures in said attachment portion sequentially become more elongated as they are positioned outward from a center aperture in said attachment portion.

11. The molded plastic siding panel of claim 8, wherein the ledge of said bottom interlocking mechanism is continuous.

12. The molded plastic siding panel of claim 8, wherein at least three whole apertures of said attachment portion are located within the length defined by each spaced apart ledge.

13. The molded plastic siding panel of claim 8, wherein the ledges are provided underneath the apertures.

14. The molded plastic siding panel of claim 8, wherein said front surface of the body has a shake-shingle pattern molded therein.

15. The molded plastic siding panel of claim 8, wherein the panel body is made of a thermoplastic resin selected from the group consisting of a polyolefin, a polycarbonate, polyvinyl chloride, and mixtures and copolymers thereof.

16. The molded plastic siding panel of claim 8, wherein said apertures in said attachment portion sequentially become more elongated as they are positioned outward from a center position in said attachment portion.

* * * * *